US006237296B1

(12) United States Patent
Chang

(10) Patent No.: US 6,237,296 B1
(45) Date of Patent: May 29, 2001

(54) TONGUE-AND-GROOVE FLOORBOARD

(76) Inventor: Chia-Ming Chang, No. 76, San-Keng-Tsu, 5th Lin, San-Keng Village, Chung-Cheng Rd., Lungtan Hsiang, Taoyuan Hsien (TW)

( * ) Notice: Subject to any disclaimer, the term of this patent is extended or adjusted under 35 U.S.C. 154(b) by 0 days.

(21) Appl. No.: 09/391,641

(22) Filed: Sep. 7, 1999

(51) Int. Cl.[7] ..... E04B 2/08

(52) U.S. Cl. ..... 52/592.1; 52/582.1; 52/589.1; 428/537.1

(58) Field of Search ..... 52/390, 391, 589.1, 52/591.1, 591.3, 592.1, 592.2, 582.1; 428/50, 53, 55, 58, 172, 537.1

(56) References Cited

U.S. PATENT DOCUMENTS

| | | | | |
|---|---|---|---|---|
| 1,864,774 | * | 6/1932 | Storm | 52/390 |
| 1,931,650 | * | 10/1933 | Elmendorf | 52/390 |
| 2,088,238 | * | 7/1937 | Greenway | 52/390 |
| 2,318,889 | * | 5/1943 | Sanford | 52/592.2 |
| 5,283,102 | * | 2/1994 | Sweet et al. | 52/391 |
| 5,566,517 | * | 10/1996 | Ishii et al. | 52/391 |
| 6,065,264 | * | 5/2000 | Imler et al. | 52/591.1 |

FOREIGN PATENT DOCUMENTS

| | | | | |
|---|---|---|---|---|
| 258794 | * | 5/1949 | (CH) | 52/390 |
| 2318533 | * | 10/1974 | (DE) | 52/390 |
| 3741907 | * | 11/1987 | (DE) | 52/390 |
| 20468 | * | 12/1915 | (DK) | 52/390 |
| 46433 | * | 11/1932 | (DK) | 52/592.1 |
| 2686 | * | of 1881 | (GB) | 52/390 |
| 8943 | * | of 1884 | (GB) | 52/390 |

* cited by examiner

*Primary Examiner*—Blair M. Johnson
(74) *Attorney, Agent, or Firm*—Dorsey & Whitney LLP

(57) ABSTRACT

A tongue-and-groove floorboard is composed of a lower board and an upper board mated with the lower board. The lower board and the upper board each have a plurality of channels and ribs longitudinally formed in pairs, wherein the channels and ribs in the lower board and the upper board are complementary. A plurality of recesses are defined between each lower board and upper board, wherein the recesses in the lower board and the upper board are corresponding and can construct circular passages. Sound insulation material is disposed in the passages in the lower board and the upper board. A plurality of slots is defined therein not parallel to the channels and ribs and being staggered respectively in the lower board and the upper board. A tongue is formed at one side of the lower board and upper board, and a groove is defined at the opposite side of the lower board and upper board.

8 Claims, 5 Drawing Sheets

TONGUE-AND-GROOVE FLOORBOARD

BACKGROUND OF THE INVENTION

1. Field of the Invention

The present invention is related to a tongue-and groove floorboard, and more particular to a floorboard which will not have any deformation and which can insulate sound.

2. Description of Related Art

Tongue-and-groove floorboards are a conventional material used in construction. A conventional tongue-and-groove floor is made of a plurality of planks, as shown in FIGS. 8–9. The tongue-and-groove floorboard (60) comprises a tongue (61) formed at one narrowside of the plank and a groove (62) defined at an opposite narrow side. A plurality of channels (63) are defined in the bottom of the floorboard (60). In construction, the tongue (61) of a first floorboard (60) is matched with the groove (62) of a second floorboard (60), and the groove (62) of the first floorboard (60) is matched with the tongue (61) of a third floorboard (60). Thus, a floor comprises a plurality of tongue-and-groove floorboards fitted together in the manner described above.

However, the conventional floorboard (60) generally has deformations caused by the differences in humidity and dampness of construction areas. If the deformation is generated on the floorboards (60) prior to construction, the deformed floorboards (60) are scrapped and thus increase the costs of construction. When the deformation is generated after the floorboards (60) have been laid as a finished floor, destroyed the entire floor must be ripped up, discarded, and the work begun again.

Therefore, it is an objective of the invention to provide an improved tongue-and-groove floorboard to mitigate and/or obviate the aforementioned problems.

SUMMARY OF THE INVENTION

The main objective of the present invention is to provide a tongue-and-groove floorboard that will not deform under varying humidity and dampness.

Another objective of the present invention is to provide a tongue-and-groove floorboard to insulate sound.

Another objective of the present invention is to provide an inexpensive tongue-and-groove floorboard.

Other objects, advantages and novel features of the invention will become more apparent from the following detailed description when taken in conjunction with the accompanying drawings.

DETAILED DESCRIPTION OF THE PREFERRED EMBODIMENT

Figure 1:
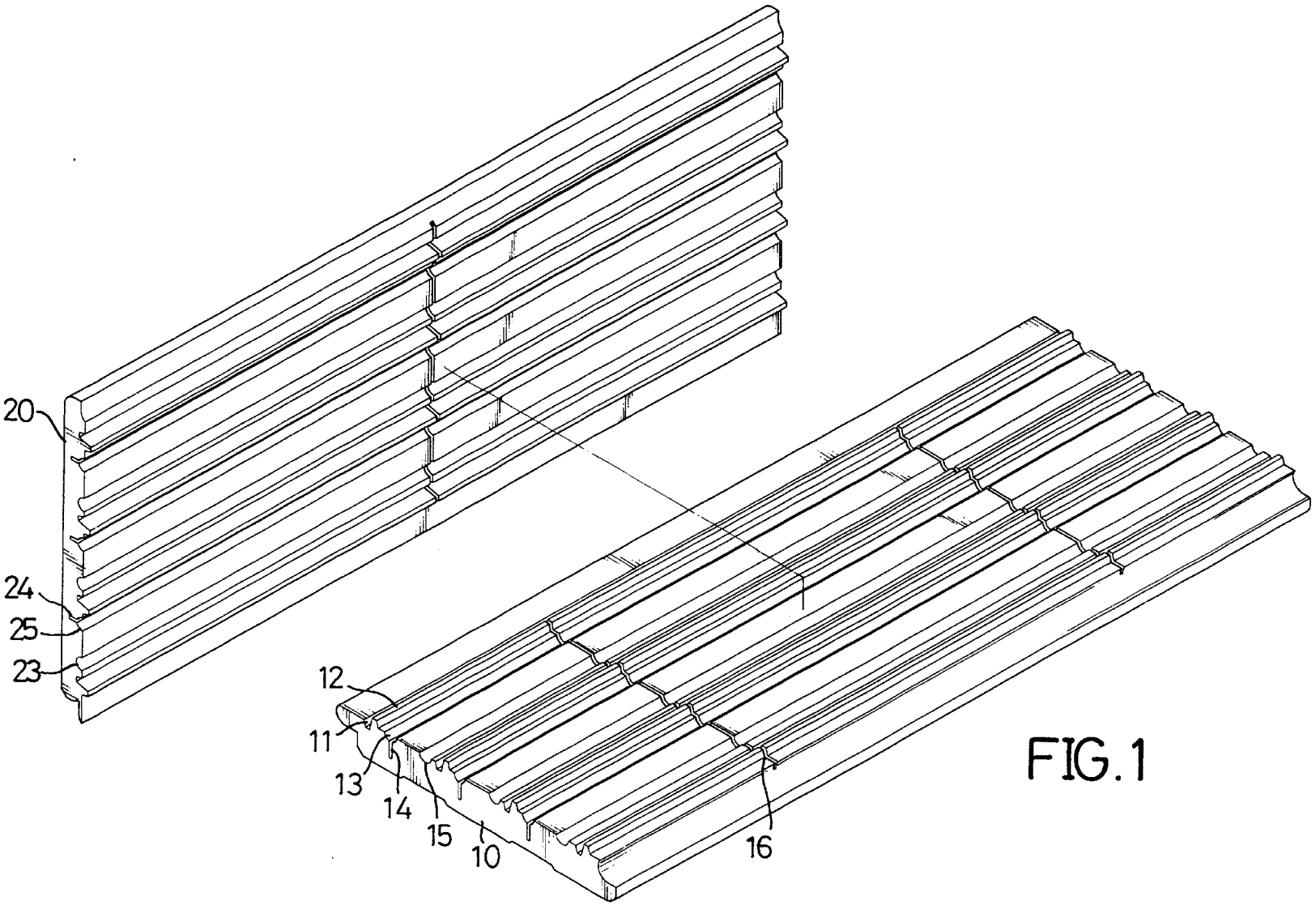
FIG. 1 is an exploded view of a tongue-and-groove floorboard in accordance with the invention.
Figure 2:
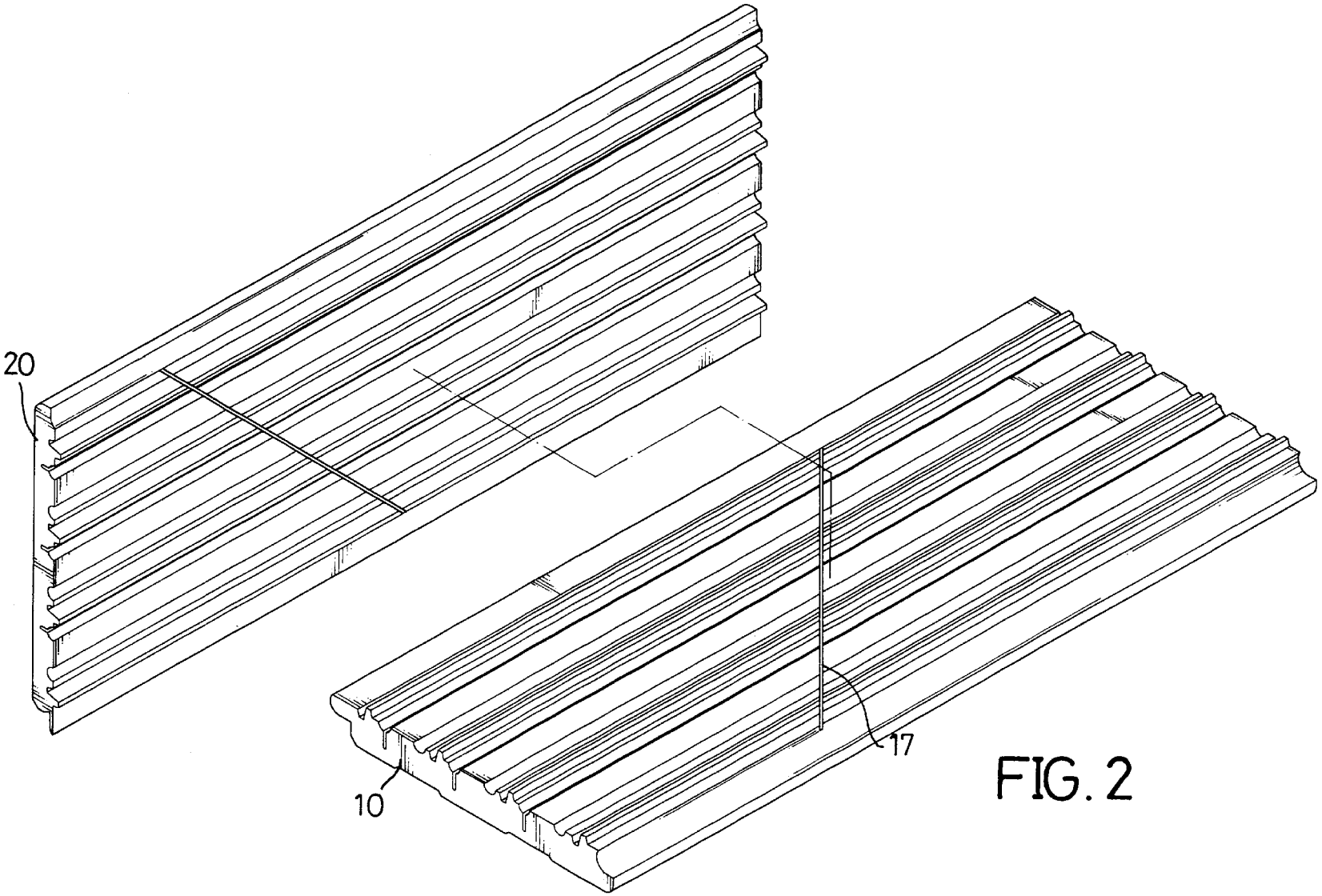
FIG. 2 is an exploded view of a second embodiment of the tongue-and-groove floorboard in accordance with the invention.
Figure 3:
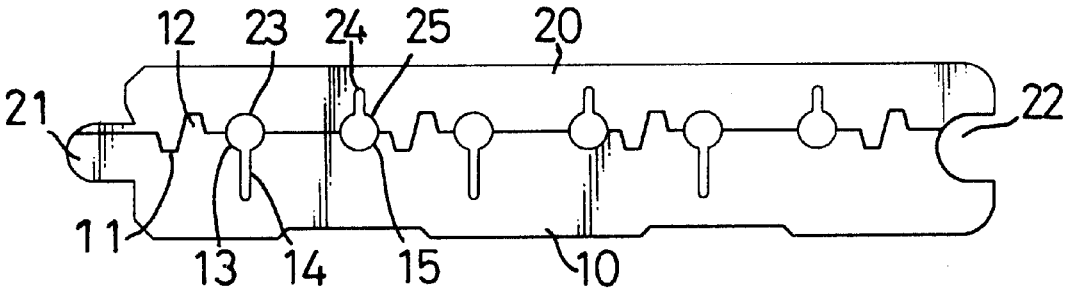
FIG. 3 is an end view of the tongue-and-groove floorboard.

Referring to FIGS. 1–3, a tongue-and-groove floorboard of the present invention is composed of a lower board (10) and an upper board (20).

The lower board (10) has a plurality of channels (11) and ribs (12) longitudinally formed in the top face thereof. The channels (11) and ribs (12) are formed in pairs and spaced apart. A plurality of recesses is defined between two pairs of channels (11) and ribs (12). In the preferred embodiment, the recesses are of two different forms a first funnel-like channel (13) and a first semi-circular channel (15) defined between two pairs of channels (11) and ribs (12). Each first funnel-like channel (13) has a first slit (14) defined at a bottom thereof. Furthermore, a plurality of slots (16) not parallel to the channels (11) and ribs (12) is defined in the top face of the lower board (10). In this embodiment, the slots (16) are perpendicular to the channels (11) and ribs (12). In another embodiment shown in FIG. 2, the slots (17) are oblique to the channels (11) and ribs (12).

The upper board (20) is matched with the lower board (10) and comprises a plurality of second funnel-like channels (25) and second semi-circular channels (23) to correspond to the channels (13,15) of the lower board (10). Each second funnel-like channel (25) has a second slit (24). Each first funnel-like channel (13) of the lower board (10) mates with a corresponding second semi-circular channel (23) of the upper board (20) and each second funnel-like channel (25) mates with a corresponding first semi-circular channel (15) to define a plurality of enclosed keyhole-like passages. The upper board (20) also has a plurality of perpendicular slots (16) or oblique slots (17) defined in the undersurface thereof. The slots (16, 17) in the lower board (10) and the upper board (20) are staggered and not overlapped with each other.

Figure 4:
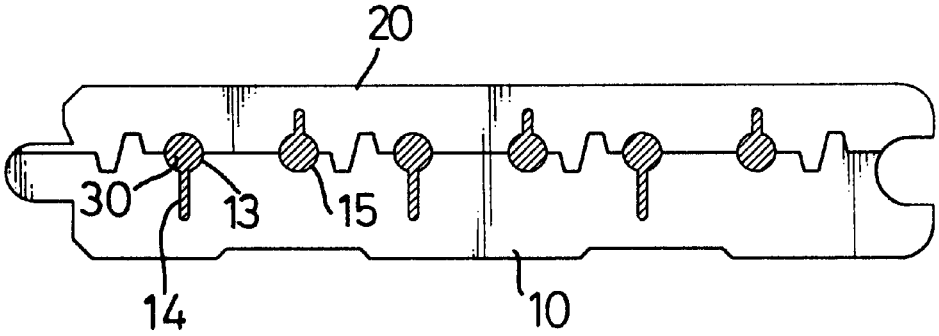
FIG. 4 is an end view of the tongue-and-groove floorboard, wherein there is expanded material deposited in recesses.

The lower board (10) and the upper board (20) are coupled together to form a tongue (21) at a first side thereof and a groove (22) at a second side opposite the first side. Sound insulation material (30) is deposited in the keyhole-like passages to insulate sound, as shown in FIG. 4. The sound insulation material (30) can be PU expanded material.

Figure 5:
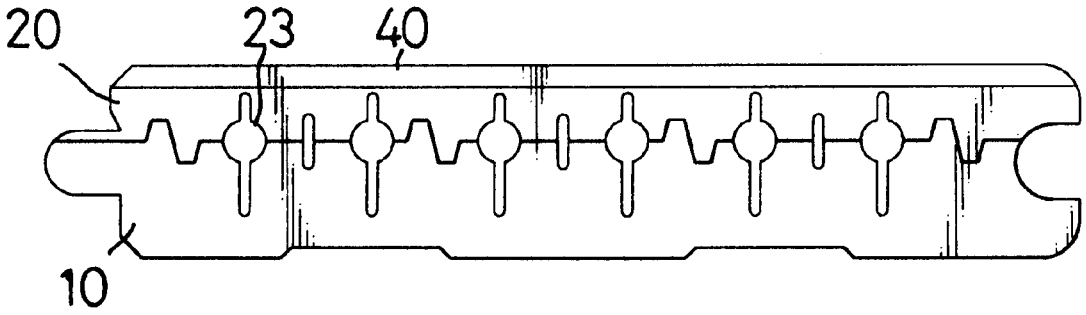
FIG. 5 is an end view of a third embodiment in accordance with the invention.
Figure 6:
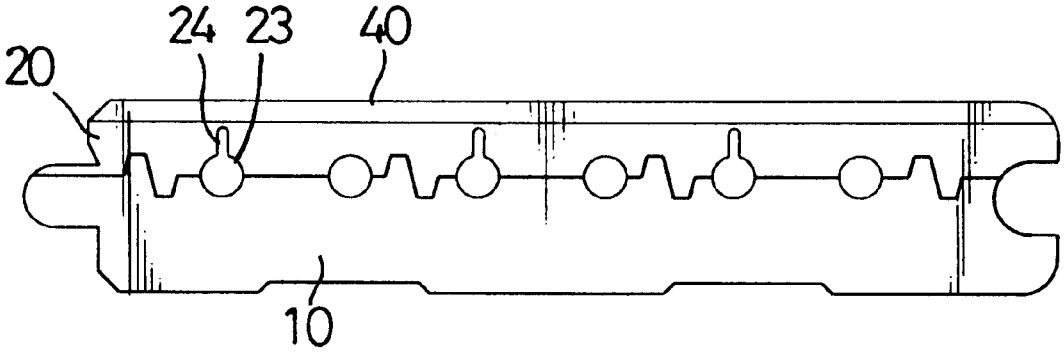
FIG. 6 is an end view of a fourth embodiment in accordance with the invention.
Figure 7:
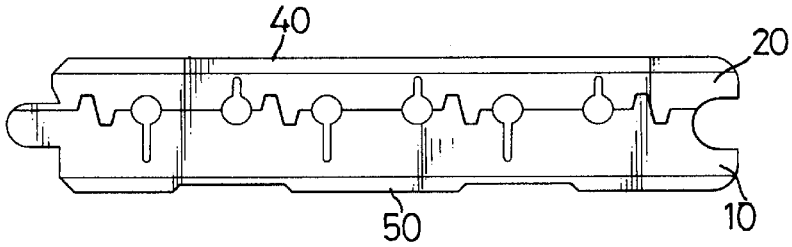
FIG. 7 is an end view of a fifth embodiment in accordance with the present invention.
Figure 8:
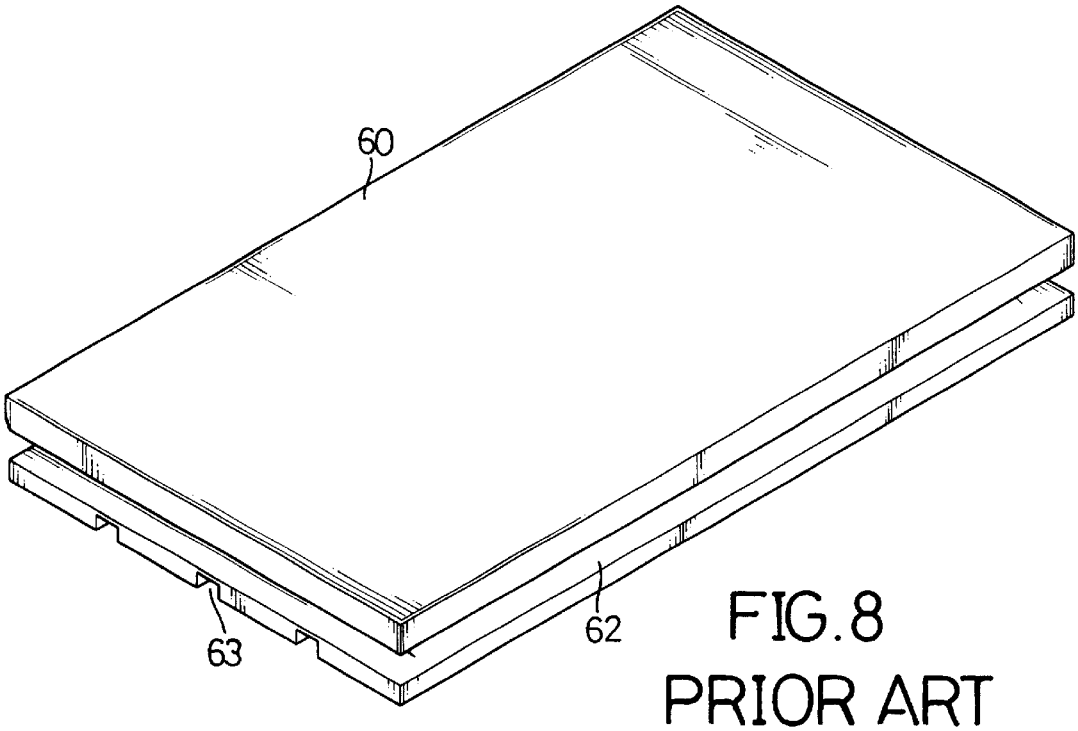
FIG. 8 PRIOR ART
FIG. 8 is a perspective view of a conventional floor.
Figure 9:
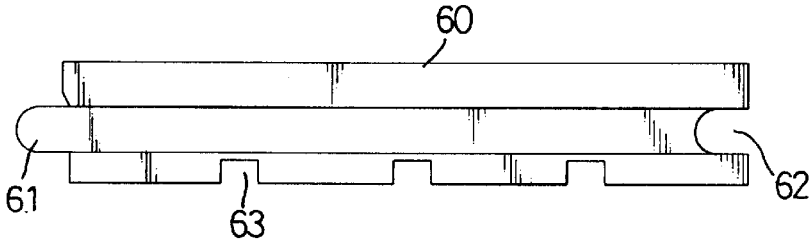
FIG. 9 PRIOR ART
FIG. 9 is an end view of the conventional floor.

FIGS. 5–7 show other embodiments of the present invention. The floor shown in FIG. 5 further comprises an upper panel (40) formed on the upper board (20). The upper panel (40) is thin and can be made of another timber different from the upper board (20). For example, the lower board (10) and upper board (20) are made of an inexpensive timber and the upper panel (40) is made of an expensive timber. The floor shown in FIG. 7, besides the upper panel (40) formed on the upper board (20), further comprises a lower panel (50) formed on the bottom of the lower board (10). In the further embodiment shown in FIG. 6, only either the upper board (20) or the lower board (10) has slits (14,24) defined therein. From the above description, it is noted that the invention has the following advantages:

1. Because there are channels (11), recesses (13, 15, 23, 25) and slits (14, 24) defined in the lower board (10) and upper board (20), the floor is not easy to deform when the temperature and humidity change.
2. The floor can insulate sound by the sound insulation material deposited in the recesses.
3. The floor can be made of an inexpensive timber other than the upper panel (40) to save money and benefit environmental protection.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tongue-and-groove floorboard comprising a lower board (10) and an upper board (20) mated with the lower board (10), said lower board (10) and said upper board (20) each comprising:

a plurality of channels (11) and ribs (12) longitudinally formed in pairs, wherein said channels (11) and ribs (12) in said lower board (10) and said upper board (20) are complementary;

a plurality of recesses defined between each lower board (10) and upper board (20), wherein said recesses in said lower board (10) and said upper board (20) are corresponding and can construct passages, each of sail passages having a keyhole-like cross-section;

sound insulation material (30) deposited in said passages constructed by said recesses in said lower board (10) and said upper board (20);

a plurality of slots (16, 17) defined therein not parallel to said channels (11) and ribs (12) and being staggered respectively in said lower board (10) and said upper board (20); and a tongue (21) formed at a first side of each of said lower board (10) and upper board (20), and a groove (22) defined in a second side opposite the first side of each of said lower board (10) and upper board (20).

2. The tongue-and-groove floorboard as claimed in claim 1, wherein said recesses are at least in-part semi-circular in cross-section.

3. The tongue-and-groove floorboard as claimed in claim 1 wherein, a first plurality of said recesses are each semi-circular in cross-section and a second plurality of said recesses are each semi-circular in cross-section with a slit defined in a bottom thereof, and mate with a respective one of said first plurality of recesses to form said passages.

4. The tongue-and-groove floorboard as claimed in claim 3 wherein, said passages with keyhole-like cross-sections are arranged in an alternating manner, such that the slit of each of said second plurality of recesses extends in a direction opposite that of an adjacent slit.

5. The tongue-and-groove floorboard as claimed in claim 1 further comprising an upper panel (40) formed on said upper board (20).

6. The tongue-and-groove floorboard as claimed in claim 1 further comprising a lower panel (50) formed under said lower board (10).

7. The tongue-and-groove floorboard as claimed in claim 6, wherein said upper panel (40) is thinner than said lower board (10) and upper board (20), and can be made of a timber different from said boards (10, 20).

8. The tongue-and-groove floorboard as claimed in claim 1, wherein the sound insulation material is an expanded PU material.

* * * * *